US008464648B2

(12) United States Patent
Villiger

(10) Patent No.: US 8,464,648 B2
(45) Date of Patent: Jun. 18, 2013

(54) INSTALLATION KIT FOR EQUIPPING A CASE AS A MULTIFUNCTIONAL, PORTABLE SECURITY SYSTEM AND CASE EQUIPPED WITH SUCH AN INSTALLATION KIT

(76) Inventor: Peter Villiger, Beinwil (CH)

( * ) Notice: Subject to any disclaimer, the term of this patent is extended or adjusted under 35 U.S.C. 154(b) by 401 days.

(21) Appl. No.: 11/884,258

(22) PCT Filed: Feb. 8, 2006

(86) PCT No.: PCT/EP2006/050742
§ 371 (c)(1),
(2), (4) Date: May 21, 2009

(87) PCT Pub. No.: WO2006/084853
PCT Pub. Date: Aug. 17, 2006

(65) Prior Publication Data

US 2009/0235847 A1 Sep. 24, 2009

(30) Foreign Application Priority Data

Feb. 14, 2005 (CH) ..... 243/05

(51) Int. Cl.
*E05G 1/00* (2006.01)

(52) U.S. Cl.
USPC ..... 109/25; 109/29; 109/33

(58) Field of Classification Search
USPC ..... 109/25, 29–34
See application file for complete search history.

(56) References Cited

U.S. PATENT DOCUMENTS 4,722,435 A * 2/1988 Mareels et al. ..... 206/1.5
4,799,435 A * 1/1989 Boutroy ..... 109/25
4,852,502 A * 8/1989 Klingberg et al. ..... 109/25
5,156,272 A 10/1992 Bouchard et al.
5,598,793 A * 2/1997 Lopez, Jr. ..... 109/25
5,615,625 A * 4/1997 Cassidy et al. ..... 109/45
5,732,638 A * 3/1998 Van Lint ..... 109/29
5,787,819 A * 8/1998 Fumanelli ..... 109/38
6,065,408 A * 5/2000 Tillim et al. ..... 109/25
6,247,415 B1 * 6/2001 Appeltans et al. ..... 109/33

(Continued)

FOREIGN PATENT DOCUMENTS

WO WO 01/06464 A 1/2001

OTHER PUBLICATIONS

International Search Report, Dec. 4, 2006.

*Primary Examiner* — Lloyd Gall
(74) *Attorney, Agent, or Firm* — McCarter & English, LLP

(57) ABSTRACT

Installation kit for equipping a case (11) as a multifunctional, portable security system (10), and case (11). The installation kit comprises a receptacle area for valuables (13), having an access opening, a cover (12.2), and a protection system. The protection system comprises an electrically triggerable igniter (14) having membrane, an ink module (17) having a liquid for inking the valuables (13), which has a connection for a pressurized connection to the igniter (14) and an outlet area for discharging the liquid, a one-piece distributor plate (18) having at least one integrated liquid channel and multiple outlet openings for the liquid, the distributor plate (18) being connectable to the outlet area of the module (17), a pressurized gas cartridge (15) connectable to the igniter (14), the activated igniter (14) penetrating the membrane, upon which gas flows from the pressurized gas cartridge (15) into the ink module (17) and thus conveys this liquid into the distributor plate (18) and from there through in the direction of the valuables (13) in order to ink them.

20 Claims, 4 Drawing Sheets

U.S. PATENT DOCUMENTS

| | | | | |
|---|---|---|---|---|
| 6,259,366 | B1 * | 7/2001 | Lindskog et al. | 340/568.7 |
| 6,497,186 | B1 * | 12/2002 | Lundblad | 109/25 |
| 6,568,336 | B2 * | 5/2003 | Van Lint | 109/29 |
| 7,121,215 | B2 * | 10/2006 | Besnard | 109/25 |
| 2002/0029728 | A1 * | 3/2002 | Walker | 109/25 |
| 2003/0005882 | A1 | 1/2003 | Fumanelli | |
| 2004/0007165 | A1 * | 1/2004 | Abe et al. | 109/20 |
| 2004/0154500 | A1 | 8/2004 | Richard et al. | |
| 2008/0115703 | A1 * | 5/2008 | Villiger | 109/25 |

* cited by examiner

INSTALLATION KIT FOR EQUIPPING A CASE AS A MULTIFUNCTIONAL, PORTABLE SECURITY SYSTEM AND CASE EQUIPPED WITH SUCH AN INSTALLATION KIT

CROSS-REFERENCE TO RELATED APPLICATIONS

This application is the U.S. national stage of International Application No. PCT/EP2006/050742 filed Feb. 8, 2006 and designating the United States, claiming priority to Switzerland application no. CH 00243/05, filed Feb. 14, 2005.

BACKGROUND OF THE INVENTION

1. Field of the Invention

The present invention relates to an installation kit for equipping a case as a multifunctional, portable security system and a corresponding case equipped as a multifunctional, portable security system.

2. Background of the Related Art

There are greatly varying security cases for transporting objects in need of protection, such as objects of value like coins and banknotes, securities, other valuables such as noble metals and precious stones, documents to be kept secret, or possibly also toxic materials, rare materials, or material to be shielded in another way, such as radioactive material.

The security cases have a strongbox area, a protection system, and an access opening, which may be closed and which makes the security case accessible in the open state.

The protection system is used for the purpose of protecting the owner or possessor of the valuables from a misuse of the valuables, if they are lost in the event of a theft. This is performed by automatically neutralizing or devaluing, in particular inking the valuables in such a case. The corresponding known protection systems are costly and complex.

As already noted, there are varying types of valuables to be transported. Depending on the type of the valuables, the cases must have different sizes. Moreover, greatly differing security guidelines may apply. Therefore, a large number of greatly varying cases are used in practice.

It is important for cases of this type that they correspond to the appropriate security guidelines, are portable, and above all are flexibly usable. Current cases only partially meet these criteria. In addition, the cases are currently relatively costly.

In addition, primary attention is still placed on the security and stability of the actual case.

SUMMARY OF THE INVENTION

It is the object of the present invention,

- to provide an installation kit for equipping a case as a multifunctional portable security system, which ensures high security, is as universally usable as possible, and may be produced and handled easily, and
- to suggest a case equipped with such an installation kit.

The present invention is to allow high flexibility in the handling ability and provide a security system which is cost-effective and which allows retrofitting or equipping of cases and similar formations of similar types of construction and manufacture and size.

This object is achieved according to the present invention for an installation kit, and for a case.

Preferred embodiments of the security system are defined by the dependent claims.

A novel path is followed according to the present invention, which allows high security to be offered at a reasonable price. One proceeds from conventional cases, as are offered in numerous shapes, sizes, and materials. Cases of this type may be equipped and/or retrofitted using an installation kit according to the present invention to form a multifunctional, portable security system. The installation kit ensures high security, which may be further increased by numerous optional measures. Due to the use of a typical case, which may also be used as a piece of luggage for normal traveling luggage, the security system is cost-effective and additional security is achieved, because it is not recognizable to an outsider that the case is a security system for transporting valuables and/or that valuables are located in the case.

The configuration of a distributor plate according to the present invention simplifies the production and makes repairs easier, because it makes mounting multiple individual partial lines for the liquid superfluous.

If valuables are located in a receptacle area, the means for their protection are armed and/or brought from an inactive, i.e., deactivated state into an armed or activated state. If the means for protecting the valuables are activated, in case of emergency, i.e., if the case or its contents are handled or actuated incorrectly, the neutralization or inking of the valuables is triggered, and the latter are neutralized or devalued by the liquid: this is to be understood to mean that the valuables are at least temporarily altered, damaged, or destroyed. This neutralization may also be performed in such a way that the valuables retain their value for the authorized possessor or owner or may obtain it again.

The installation kit comprises a receptacle area for receiving valuables. The receptacle area is accessible via an access opening, which may be covered using a cover and/or is closable depending on the embodiment. In addition, a protection system is provided which comprises protection means having an igniter, which may be triggered by applying an electrical signal. Furthermore, an ink module having a liquid for inking the valuables is provided. The ink module is connected via a pressure connection to the igniter and has an outlet area for discharging the liquid. A distributor plate is provided which is produced in one piece and has at least one integrated liquid channel as well as a number of outlet openings for the liquid. The distributor plate may be connected to the outlet area of the ink module. A pressurized gas cartridge, which is connected to the igniter, provides the required gas pressure after the igniter is triggered to convey liquid from the ink module into the liquid channel of the distributor plate and from there through the outlet openings of the distributor plate in the direction of the valuables, so that they are inked.

An advantageous configuration is obtained if the ink module forms an assembly with the distributor plate, the distributor plate being connectable pressure-tight to the outlet area of the ink module upon attachment to the ink module. The tightness is to be maintained over the largest temperature range possible.

It is favorable if the cover for covering the access opening is designed in such a way that it delays immediate access to the valuables in the receptacle area. In the event of unauthorized access without prior transfer of the security switch into the disarmed state, the neutralization and/or inking of the valuables may thus be triggered by the security circuit.

The protection system may comprise further protection means or security features which are situated either in the receptacle area or the case. Such protection means are used for the purpose of protecting the case against greatly varying types of attacks or in greatly varying situations.

The protection system comprises a security circuit which is connectable to the igniter and provides the electrical signal for triggering the igniter in an emergency situation, as well as a security interface, which allows the security circuit to be an armed or brought into a disarmed state as needed. In addition, the safety system may have a power source or a power store for supplying it with power.

In an especially preferred embodiment, the security system formed by the installation kit in the case and/or the protection system of the case is armed or disarmed by a Pocket PC or a computer via an interface. The protection system is advantageously capable via the security interface of establishing a further communication capability between the security circuit and an external device, preferably a portable computer.

The security circuit used for this purpose is preferably an electrical/electronic circuit. This security circuit is a part of the protection system.

The cited security interface may be designed to establish a contactless connection and comprises a transmitter and a receiver, this preferably being an infrared connection and this connection allowing encrypted communication. However, transmitters and receivers which operate using RF or other waves are also possible.

Furthermore, an interface may be provided to read an RFID chip or bar code, to only then allow release (opening). Such an RFID chip or bar code may be situated at the target location (for example, at a bank). Only after the RFID chip or the bar code is recognized by the security circuit is the security system released.

As an additional protective measure, the protection system may comprise means for surface protection, which may be inserted or installed in the case and enclose the receptacle area. These means may be electrically connectable to the security circuit to trigger the neutralization and/or inking of the valuables via the security circuit in the event of an attempt to damage or penetrate the case. Protective films, networks, lattices, or fabrics may be used as the means for surface protection to ensure protection against breaking open, cutting through, or drilling through.

The protection system may also comprise an impact sensor as an additional protective measure, which may be installed in the case. The impact sensor is electrically connectable to the security circuit and triggers the neutralization and/or inking of the valuables via the security circuit in the event of a predefined number or frequency of impacts and/or shocks.

To further increase the security, a movement sensor may be provided, which is deactivated in the event of manipulation or transport of the case by authorized persons.

Additional protection of the valuables may be achieved if a seal or lead seal of a mechanical or electronic nature is provided for the case or the receptacle area. Such a seal or lead seal is not primarily intended to prevent opening of the container, but rather to be able to establish unauthorized, but unforced opening, for example, by a person authorized to transport the case.

The protection system may be implemented so that an access to the receptacle area is possible with or without actuation of an additional auxiliary element, such as a (contactless) key.

A further security precaution may be achieved by additional modules, which generate smoke in the event of unauthorized manipulation of the security system. This has a signal effect and prevents a criminal from carrying away the case.

Still a further security precaution may comprise an airbag system being situated in or on the case. Such an airbag system must be conceived in such a way that it is activated or activatable in the event of unauthorized handling of the security system. Unauthorized manipulations of the security system are made more difficult by the volume increase occurring upon actuation of the airbag system and a criminal is possibly prevented from carrying away the case.

The novel case is used, as already noted, as a multifunctional, portable security system together with the novel kit.

The case is preferably implemented in such a way that its external cover part and its external floor part protect the receptacle area in the interior against moisture and mechanical damage and preferably also against high temperatures in the closed state.

The case is preferably a conventional, sufficiently rigid case, such as a hardshell case, which is preferably manufactured from a plastic material.

The case may comprise all protective measures which have been explained above with reference to the novel installation kit.

In particular, the case may establish a communication connection between the security circuit and an external device, preferably a portable computer, via the security interface.

Further features and details of the present invention are explained in greater detail in the following on the basis of exemplary embodiments and with reference to the drawing.

Figure 1A:
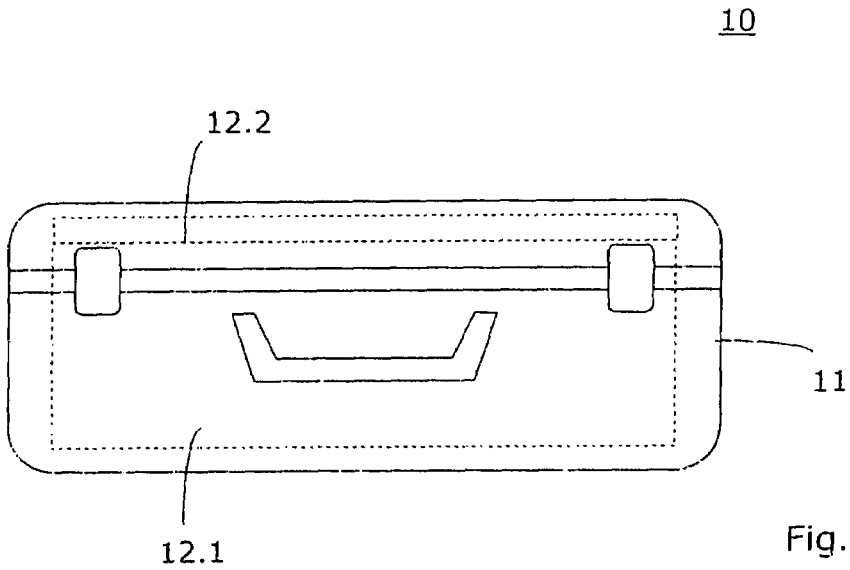
FIG. 1A shows a case according to the present invention in a schematic side view.

Fundamentally identical or identically acting constructive elements are provided with identical reference numerals in the figures, even if they partially differ from one another. Specifications such as top, bottom, right, left, front, and rear relate to the position of the elements thus identified in the particular figures.

DETAILED DESCRIPTION OF EMBODIMENTS OF THE INVENTION

Figure 1B:
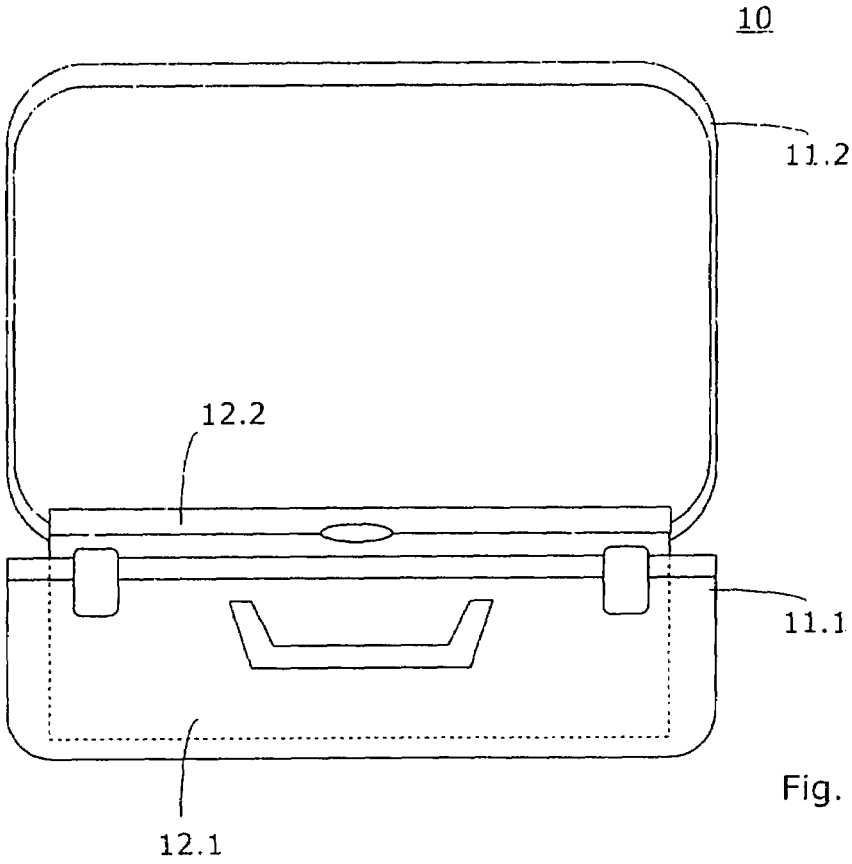
FIG. 1B shows a schematic side view of the open case from FIG. 1A, the case being opened and the receptacle area being closed.
Figure 1C:
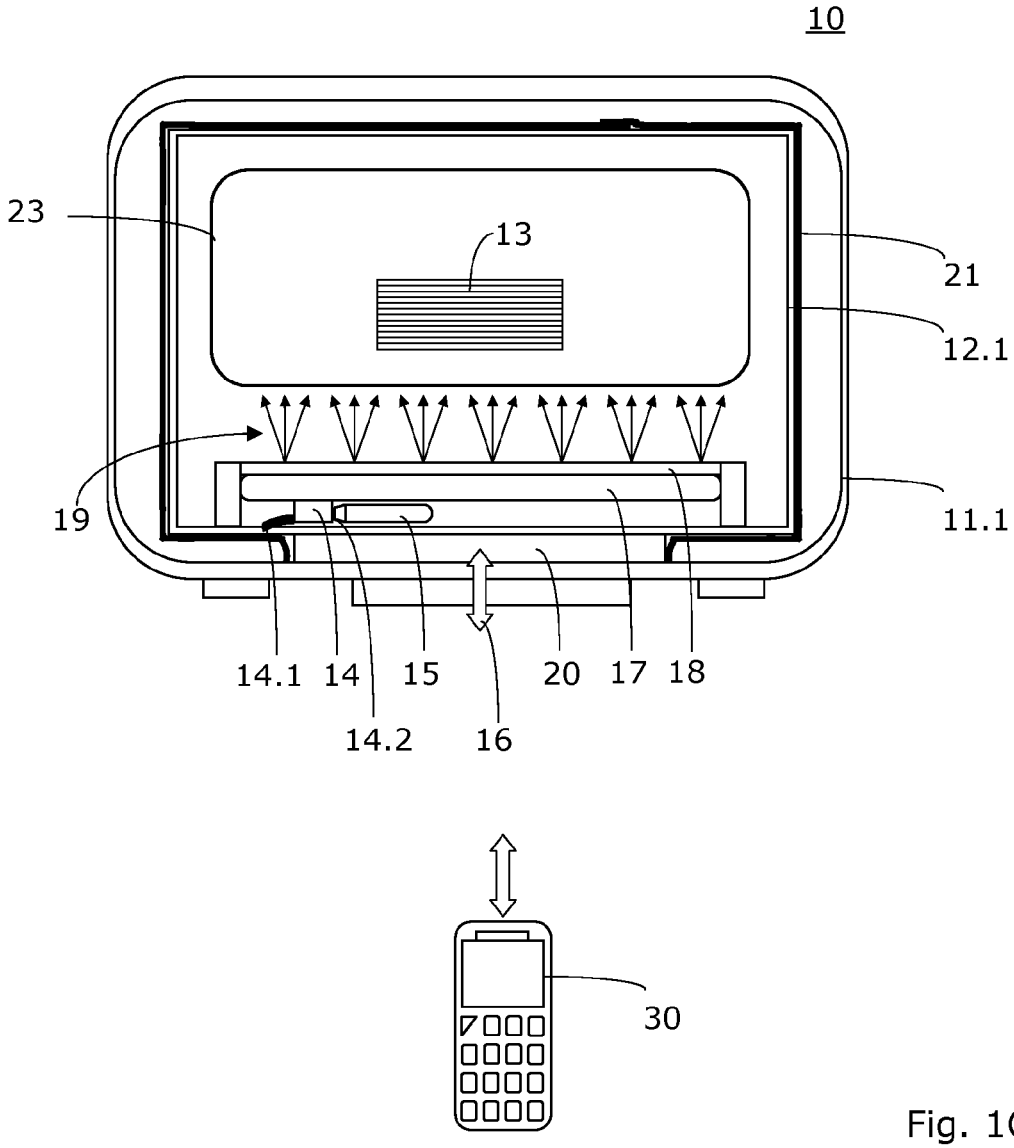
FIG. 1C shows a schematic top view of the open case from FIG. 1A, the receptacle area being open, and of an external device.

FIG. 1A through FIG. 1C show various views of an exemplary embodiment of the present invention. A case 11 is shown in FIG. 1A, which is equipped as a multifunctional, portable security system 10 using an installation kit according to the present invention. The case 11 is shown in the closed state.

The case 11 has an external floor part 11.1 and an external cover part 11.2, which are connected pivotably to one another. A handle and two snap closures or snap locks are indicated on the front of the case 11. A receptacle area located in the case 11 is indicated in FIG. 1A using dashed lines. This receptacle area is essentially located in the interior of the external floor part 11.1 and is designed to accommodate schematically illustrated valuables 13 (see FIG. 1C). The receptacle area is accessible via an access opening when the external cover part 11.2 is open, as shown in FIG. 1B. In the exemplary embodiment shown, the receptacle area is enclosed by a cassette which has a floor trough 12.1 and a trough cover 12.2 for covering the access opening. Multiple receptacle areas may also be provided.

The receptacle area may be secured by one or more security means. According to the present invention, an igniter 14 having a membrane 14.2 is provided, which may be triggered by the application of an electrical signal, as shown in FIG. 1C. An ink module 17, which contains a liquid for neutralizing and/or inking the valuables 13, is connected to the igniter 14 and a distributor plate 18.

The term ink module is also to be understood as a module having a liquid other than ink or having another free-flowing medium, accordingly, the term a liquid is also to be understood as another free-flowing medium, and the term inking of the valuables 13 is also to be understood as another change which may be caused by a free-flowing medium, such as etching. Multiple ink modules may also be provided, in particular, multiple ink modules may be implemented and situated in such a way that liquid may be discharged onto the valuables 13 from multiple directions.

The ink module 17 has a connection for producing a pressurized connection to the igniter 14 and an outlet area for discharging the liquid. The distributor plate 18 has at least one integrated liquid channel and a number of outlet openings for the liquid. The distributor plate 18 is produced in one piece and is connectable to the outlet area of a module 17. The module 17 forms an assembly with the distributor plate 18, the distributor plate 18 being connectable pressure-tight to the outlet area of the ink module 17 upon being fastened to the ink module 17.

A pressurized gas cartridge 15 is connected to the igniter 14 in such a way that the igniter 14 is triggered upon application of the electrical signal and penetrates the membrane 14.2 of the igniter 14. Gas is thus discharged from the pressurized gas cartridge 15 and conducted via the pressurized connection into the ink module 17. Under this pressure, the liquid goes from the ink module into the liquid channel of the distributor plate 18 and in the direction of the valuables 13 through the outlet openings of the distributor plate 18. The inking of the valuables 13 is illustrated by arrows 19 in FIG. 1C.

FIG. 1C also shows a circuit 20 having a security interface 16, via which the circuit 20 is activatable by an external control element such as a computer 30, as is schematically illustrated. The external control element 30 is essentially used for the purpose of bringing the protection system from a disarmed or passive state into an armed or active state. The igniter 14 is only triggered in the event of unauthorized handling of the security system and the neutralization or inking of the valuables is only initiated when the protection system is armed or activated.

Figure 2A:
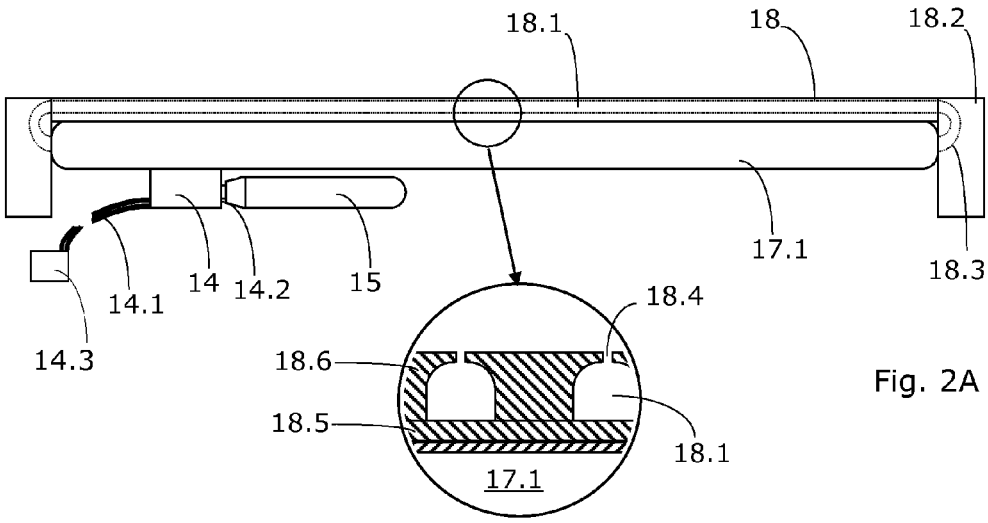
FIG. 2A shows a schematic side view of a part of the protection system according to the present invention.
Figure 2B:
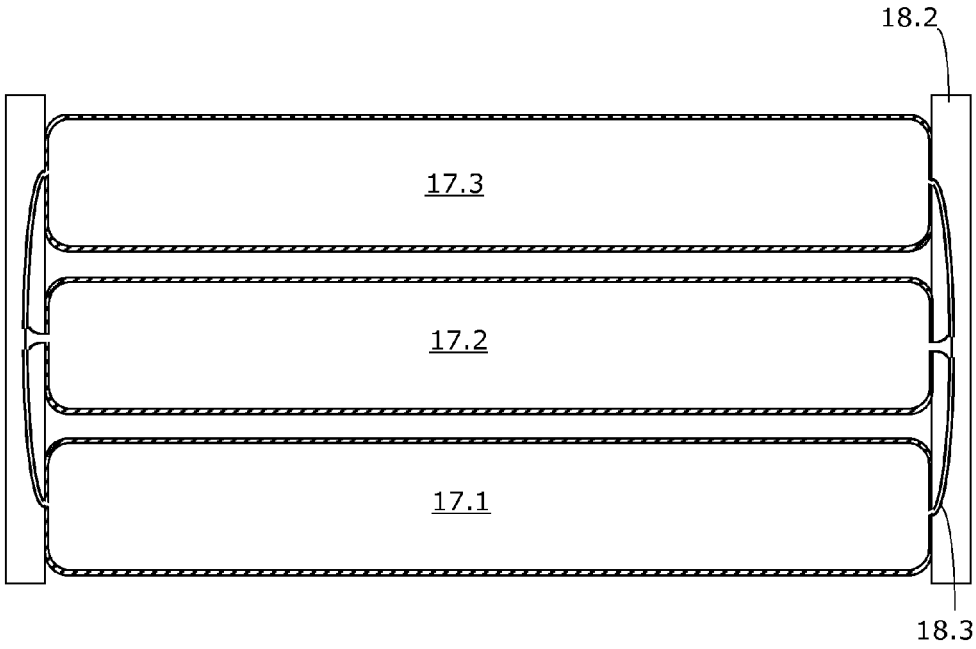
FIG. 2B shows a schematic sectional view of a part of the protection system according to the present invention shown in FIG. 2A.
Figure 2C:
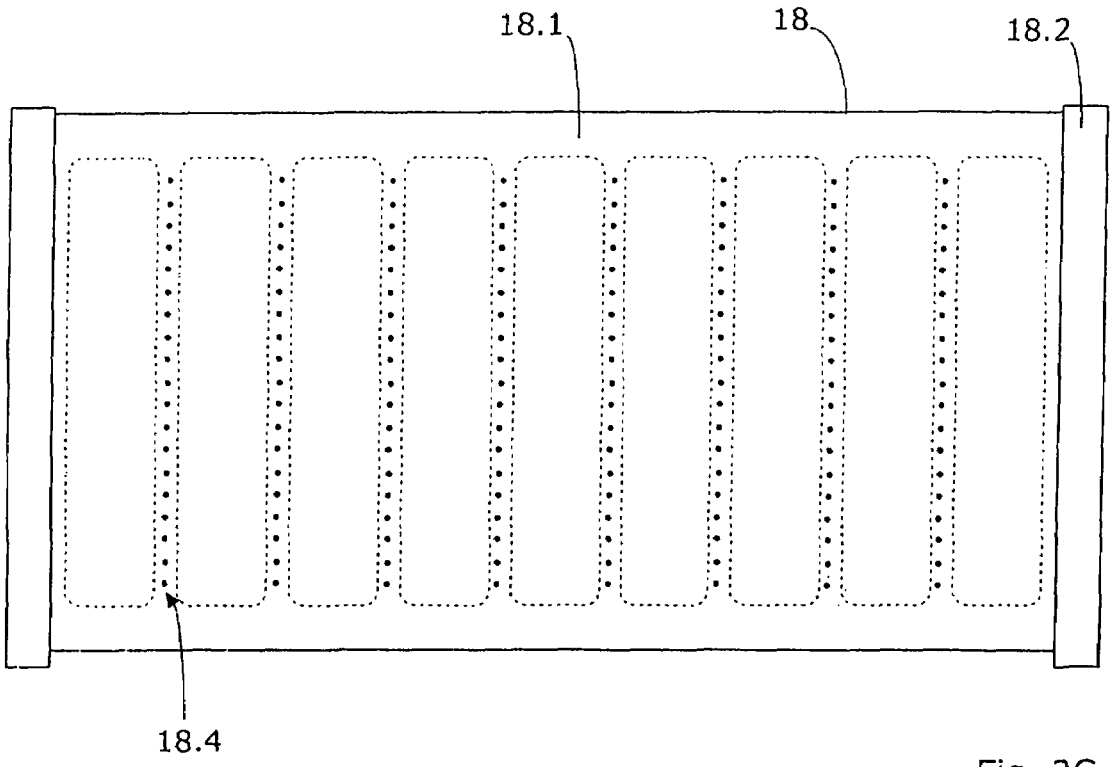
FIG. 2C shows a schematic top view of a part of the protection system according to the present invention shown in FIG. 2A.

FIGS. 2A, 2B, and 2C show details of a further protection system, in which the ink module 17 comprises three partial modules 17.1, 17.2, 17.3. Another number of partial modules and/or another spatial configuration of the partial modules is also possible. The igniter 14 and an electrical terminal 14.1 for the igniter 14 are shown in FIG. 2A, via which the igniter 14 may be triggered, power therefor supplied by a power source 14.3. The pressurized gas cartridge 15 is also shown in FIG. 2A. The distributor plate 18 has a connection system 18.2 according to FIGS. 2A through 2C. The distributor plate 18, more precisely its chamber or liquid channel 18.1 intended for guiding liquid, is connected via one or more channels 18.3 of the connection system 18.2 to the interior of the ink module 17. The connection system 18.2 may be used as a lateral mounting element to mechanically and "hydraulically" connect the distributor plate 18 to the ink modules 17.1-17.3.

The detail shown enlarged in the style of a loupe in relation to FIG. 2A shows a vertical section through the ink module 17.1 and the distributor plate 18. It may be seen therefrom that the distributor plate 18 has a bottom plate part 18.5 and a top plate part 18.6, which press against one another to form a seal. The plate parts 18.5, 18.6 delimit the cited liquid channel 18.1. The outlet openings 18.4 are situated in the upper plate part 18.6.

Distributor plates in other constructions are also conceivable. It is essential that the liquid channel 18.1, which may also have multiple liquid channels connected in parallel if necessary, may only be filled via the connection system 18.3 and may only be emptied via the outlet openings 18.4. Distributor plates may be produced from various materials, in particular from light metal or suitable plastics.

FIG. 2C shows the distributor plate of the protection system from above, having the liquid channel 18.1, the connection system 18.2, the outlet openings 18.4, and the upper plate part 18.6. Nine areas of the upper plate part 18.6 are shown by dashed lines, around which the liquid channel 18.1 having the outlet openings 18.4 zigzags or meanders.

Figure 3:
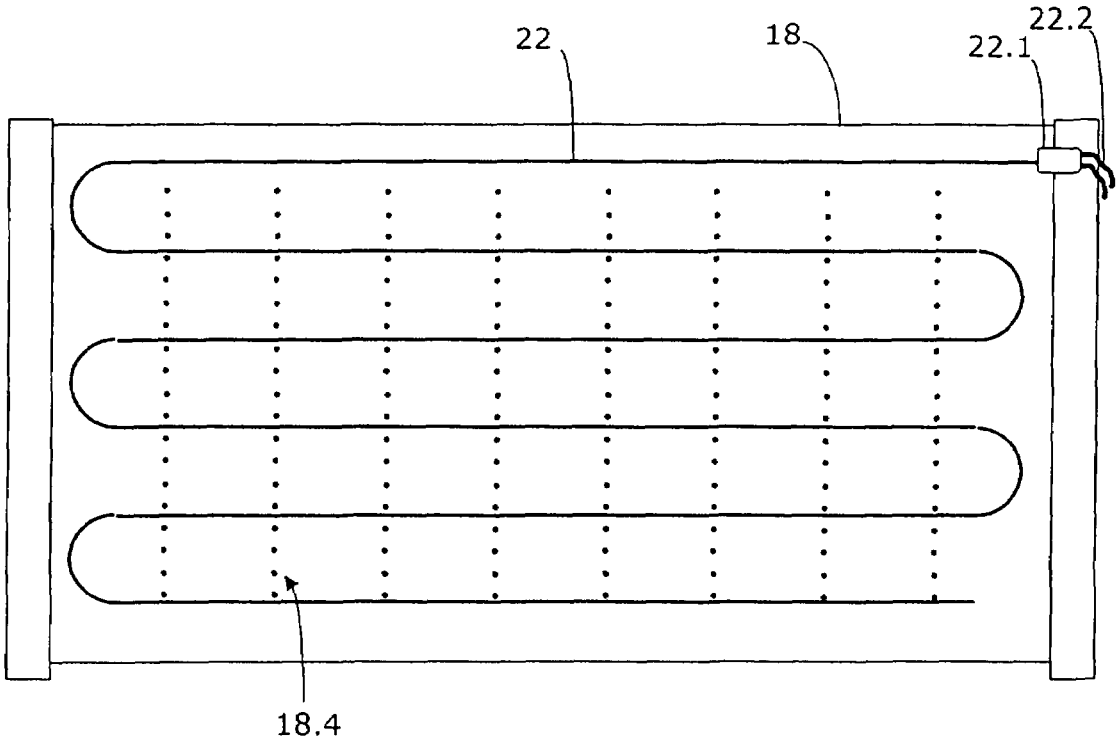
FIG. 3 shows a schematic top view of a part of a further embodiment of a protection system according to the present invention.

The valuables are frequently packaged in a sack (sealed bag) 23. The sacks have a closure which allows the sack to be closed after being filled with valuables. After being closed, such a sack may no longer be opened without leaving traces. The receiver of the sack may thus establish whether the sack has been opened. In order that neutralization of the valuables also functions when they are located in a sack 23, according to the present invention, a special fuse is provided, which develops heat after being ignited and melts the sack 23. The valuables may thus be reached by the ink even when they are located in a sack 23. The present invention offers the advantage that the required fuse may be inserted in the distributor plate 18 or fastened thereto. A corresponding embodiment is indicated in FIG. 3. Analogously to FIG. 2C, a schematic top view of another embodiment of a distributor plate 18 is shown in FIG. 3.

FIG. 3 shows the distributor plate 18 of the protection system from above. At least one, but preferably two fuses 22 are provided on the surface of the distributor plate 18. These fuses 22 are preferably situated in a meandering way. In order that the fuse(s) may be fastened to the distributor plate 18, the distributor plate has a superficially implemented channel in a preferred embodiment, into which the fuse(s) 22 may be inserted. In the example shown, a detonator 22.1 is provided, which may be ignited via two cables 22.2. The two cables 22.2 may be connected to the security circuit 20. As soon as neutralization of the valuables is needed, the security circuit 20 ignites the detonator 22.1 and thus triggers burning of the fuse(s) 22. These fuses melt the sack. The valuables are thus reachable by the ink, which is discharged from the openings 18.4 with pressure.

In a further embodiment, the case 10 may be fastened in a rack. For this purpose, the rack may be equipped with an interlocking function. As soon as the case 10 is connected to the rack via the interlocking function, a circuit on the rack assumes at least a part of the security functions and/or the monitoring of the security functions. Removal from the rack may be performed via a PDA having a suitable interface, for example.

What is claimed is:

1. An installation kit for equipping a case having an external floor part and an external cover part as a multifunctional, portable security system, the kit comprising:

a receptacle area for connecting with a separate floor trough configured for receiving valuables located within a sack, the receptacle area being accessible via an access opening, a trough cover for covering the access opening, and a protection system comprising:

an igniter having a membrane, which may be triggered by applying an electrical signal, an ink module, which encloses a liquid for inking the valuables, the ink module having a connection for producing a pressurized connection to the igniter and an outlet area for discharging the liquid, a distributor plate, which is produced in one piece and has at least one integrated liquid channel and a number of outlet openings for the liquid, the distributor plate being connectable to the outlet area of the ink module, a fuse in or on the distributor plate, wherein the fuse is configured to develop heat after being ignited in an amount that is sufficient for melting said sack, and a pressurized gas cartridge, which is connectable to the igniter in such a way that the igniter penetrates the membrane upon application of the electrical signal, to discharge gas from the pressurized gas cartridge and conduct it via the pressurized connection into the ink module and thus convey the liquid into the liquid channel of the distributor plate and from there through the outlet openings of the distributor plate in the direction of the valuables, in order to ink them.

2. The installation kit according to claim 1, wherein the protection system further comprises the following:

a security circuit, which is connectable to the igniter and provides the electrical signal for triggering the igniter in an emergency situation, a security interface, which allows the security circuit to be brought at least one of into a disarmed state and back into an armed state, and a power source for supplying the protection system with power.

3. The installation kit according to claim 2, wherein the protection system further comprises means for surface protection, which may be inserted or installed in the case, said means a) enclosing the receptacle area and b) being electrically connectable to the security circuit in order to trigger the inking of the valuables via the security circuit in the event of an attempt to damage or penetrate the case.

4. The installation kit according to claim 2, wherein the protection system further comprises an impact sensor electrically connectable to the security circuit and triggering the inking of the valuables via the security circuit in the event of a predefined number of impacts or shocks.

5. The installation kit according to claim 2, wherein the protection system is capable of establishing a communication connection between the security circuit and at least one of an external device and a portable computer, via the security interface.

6. The installation kit according to claim 5, wherein the security interface is designed for establishing a contactless connection and comprises a transmitter and a receiver.

7. The installation kit according to claim 1, wherein the ink module forms an assembly with the distributor plate, the distributor plate being connectable pressure-tight to the outlet area of the ink module upon being fastened to the ink module.

8. The installation kit according to claim 1, wherein the fuse is provided with a detonator, which may be triggered by a security circuit.

9. The installation kit according to claim 6, wherein the contactless connection is one of an infrared connection and an RF connection.

10. The installation kit according to claim 6, wherein the contactless connection allows encrypted communication between the transmitter and the receiver.

11. A case with an installation kit, configured as a multifunctional, portable security system, having:

an external floor part and an external cover part, which are pivotably connected to one another, a floor trough with a floor in the interior of the external floor part configured for receiving valuables located within a sack, the floor trough being accessible via an access opening when the external cover part is open, and a trough cover for covering the access opening, wherein the installation kit comprises a protection system comprising:

an igniter having a membrane, which may be triggered by applying an electrical signal, an ink module, which encloses a liquid for inking the valuables, the ink module having a connection for producing a pressurized connection to the igniter and an outlet area for discharging the liquid, a distributor plate which is produced in one piece and has at least one integrated liquid channel and a number of outlet openings for the liquid, the distributor plate being connectable to the outlet area of the module, a fuse is provided in or on the distributor plate, wherein the fuse is configured to develop heat after being ignited in an amount that is sufficient for melting said sack, and a pressurized gas cartridge, which is connectable to the igniter in such a way that the igniter penetrates the membrane upon application of the electrical signal to discharge gas from the pressurized gas cartridge and conduct it via the pressurized connection into the ink module and thus convey the liquid into the liquid channel of the distributor plate and from there through the outlet openings of the distributor plate in the direction of the valuables, in order to ink them.

12. The case according to claim 11, wherein the external cover part and the external floor part protect the floor trough in the interior against at least one of moisture, mechanical damage, and high temperatures when in a closed state.

13. The case according to claim 11 or 12, wherein the external floor part and the external cover part define a rigid hardshell case.

14. The case according to claim 11 or 12, wherein the protection system further comprises the following:

a security circuit, which is connectable to the igniter and provides the electrical signal for triggering the igniter in an emergency situation, a security interface, which allows the security circuit to be put into a disarmed state, and a power source for supplying the protection system with power.

15. The case according to claim 14, wherein the case is capable of establishing a communication connection between the security circuit and at least one of an external device and a portable computer, via the security interface.

16. The case according to claim 14, wherein the cover for covering the access opening is designed in such a way that it delays immediate access to the valuables in the floor trough, the security circuit triggering the inking of the valuables in the event of unauthorized access without prior transfer of the security circuit into the disarmed state.

17. Method of equipping a case as a multifunctional, portable security system, comprising the steps:

providing a case with an external floor part and an external cover part;

providing an installation kit with a receptacle area for connecting with a separate floor trough configured for receiving valuables located within a sack, the receptacle area being accessible via an access opening, covering the access opening with a trough cover, and providing the installation kit with a protection system comprising:

an igniter having a membrane, an ink module, which encloses a liquid for inking the valuables, the ink module having a connection for producing a pressurized connection to the igniter and an outlet area for discharging the liquid, a distributor plate, which is produced in one piece and has at least one integrated liquid channel and a number of outlet openings for the liquid, a fuse in or on the distributor plate, and a pressurized gas cartridge, installing said installation kit within said case;

configuring the igniter so that it may be triggered by applying an electrical signal;

connecting the distributor plate to the outlet area of the ink module, configuring the fuse such as to develop heat after being ignited in a sufficient amount to thereby melt the sack, and connecting the gas cartridge to the igniter in such a way that the igniter penetrates the membrane upon application of the electrical signal, to discharge gas from the pressurized gas cartridge and conduct it via the pressurized connection into the ink module and thus convey the liquid into the liquid channel of the distributor plate and from there through the outlet openings of the distributor plate in the direction of the valuables and ink the valuables.

18. The method according to claim 17, further comprising the steps of:

providing the installation kit with a security circuit;

connecting said security circuit to the igniter so that it can provide the electrical signal for triggering the igniter in an emergency situation;

providing the installation kit with a security interface, which allows the security circuit to be put into a disarmed state, and providing the installation kit with a power source for supplying the protection system with power.

19. The method according to claim 18, further comprising the step of configuring the case for establishing a communication connection between the security circuit and at least one of an external device and a portable computer, via the security interface.

20. The method according to claim 17 including sufficiently melting the sack with the heat for the ink to reach and ink the valuables.

* * * * *